US007878023B2

(12) United States Patent
Heinbokel

(10) Patent No.: US 7,878,023 B2
(45) Date of Patent: Feb. 1, 2011

(54) REFRIGERATION CIRCUIT

(75) Inventor: Bernd Heinbokel, Cologne (DE)

(73) Assignee: Carrier Corporation, Farmington, CT (US)

( * ) Notice: Subject to any disclaimer, the term of this patent is extended or adjusted under 35 U.S.C. 154(b) by 751 days.

(21) Appl. No.: 11/816,548

(22) PCT Filed: Feb. 21, 2005

(86) PCT No.: PCT/EP2005/001785

§ 371 (c)(1),
(2), (4) Date: Aug. 17, 2007

(87) PCT Pub. No.: WO2006/087013

PCT Pub. Date: Aug. 24, 2006

(65) Prior Publication Data

US 2009/0223245 A1 Sep. 10, 2009

(30) Foreign Application Priority Data

Feb. 18, 2005 (WO) ..... PCT/EP2005/001721

(51) Int. Cl.
*F25B 1/00* (2006.01)

(52) U.S. Cl. ..... 62/498; 62/513

(58) Field of Classification Search ..... 62/498, 62/513, 293, 298, 299, 228.3; 137/233, 383, 137/599.18
See application file for complete search history.

(56) References Cited

U.S. PATENT DOCUMENTS 1,601,445 A 9/1926 Hilger
4,493,010 A * 1/1985 Morrison et al. ..... 361/698
5,220,810 A * 6/1993 Keltner ..... 62/292
5,802,860 A 9/1998 Barrows
5,875,638 A * 3/1999 Tinsler ..... 62/149
6,983,613 B2 1/2006 Dube
2005/0153271 A1 * 7/2005 Wenrich ..... 435/1.1

FOREIGN PATENT DOCUMENTS

GB 602854 6/1948

OTHER PUBLICATIONS

Translation of JP 2000-161808 Ato Fujishiro et al from an IDS endorsed by the Applicant.*
Patent Abstracts of Japan, vol. 017, No. 671, Dec. 10, 1993 (JP 05 223367 A), Nippondenso Co. Ltd., Aug. 31, 1993.
Patent Abstracts of Japan, vol. 2000, No. 09, Oct. 13, 2000 (JP 2000 161808 A), Mitsubishi Electric Corp., Jun. 16, 2000.

* cited by examiner

*Primary Examiner*—Mohammad M Ali
(74) *Attorney, Agent, or Firm*—Bachman & LaPointe, P.C.

(57) ABSTRACT

Refrigeration circuit (1, 1') for circulating a refrigerant in a predetermined flow direction through at least one functionally disconnectable component, the refrigeration circuit having in flow direction an expansion device (b, b', 26, 26', 33), an evaporator, a compressor (2, 2', 29, 36) and a heat-rejecting heat exchanger (6, 20), wherein an upstream-side shut-off valve is provided upstream of the component and a downstream-side shut-off valve is provided downstream of the component, wherein at least one of these shut-off valves is a non-return valve (a, c, 25, 27, 32, 34). Preferably, the component has in flow direction the expansion device (b, b', 26, 26', 33) and the evaporator (12, 12', E1, E1', E2) or the compressor (2, 2'). Preferably the non-return valve (a, c, 25, 27, 32, 34) is lockable in it's open position.

16 Claims, 2 Drawing Sheets

REFRIGERATION CIRCUIT

BACKGROUND OF THE INVENTION

The present invention relates to a refrigeration circuit for circulating a refrigerant in a predetermined flow direction through at least one functionally disconnectable component, the refrigeration circuit comprising in flow direction an expansion device, an evaporator, a compressor, and a heat-rejecting heat exchanger, wherein an upstream-side shut-off valve is provided upstream of the component and a downstream-side shutoff valve is provided downstream of the component.

Refrigeration circuits of different kinds using single or multi-component refrigeration media, operating in normal or supercritical modes, etc. are well known to a person skilled-in-the-art.

Refrigeration circuits comprises—in flow direction—a compressor, a heat-rejecting heat exchanger (which may be gas cooler/condenser), an expansion device (e.g. a throttle valve) and an evaporator. The German patent application 10 2004 038640 discusses a refrigeration circuit according to the state of the art.

Furthermore, a refrigeration circuit according to the state of the art will be explained with respect to the enclosed FIG. 1.

The refrigeration circuit 1 as shown in FIG. 1 can be used for example for supermarket or industrial refrigeration. In flow direction the refrigeration circuit 1 comprises a compression stage, consisting of two or more compressors 2, 2' arranged in parallel. Each of these compressors 2, 2' comprises a suction-side shut-off valve 3, 3' as well as a discharge-side shut-off valve 4, 4'.

Via conduit 5 the compressed refrigerant is led to a gas cooler/condenser 6, in which the refrigerant is cooled or liquefied, respectively. Subsequent to the gas cooler/condenser 6 a receiver 8, to which the refrigerant is led via conduit 7, collects and stores the refrigerant for subsequent delivery—via conduits 9, 10 and shut-off valve a'—to one or a plurality of throttle valves b, b' of one or a plurality of refrigeration consumer(s). Via conduit and pressure relief valve 16 gaseous refrigerant can be withdrawn from the receiver 8.

Connected to each throttle valve b, b' is an evaporator 12, 12'. Via conduits 11, 13, 15 and shut-off valve c' the evaporator outlets 12, 12' are connected to the entrances of the compressors 2, 2'.

In FIG. 1 an arrangement of two or more throttle valves b, b' and evaporators 12, 12' is shown. Via conduits 10' and 11' further throttle valves and evaporators can be connected to this arrangement. Via conduits 9' and 13' at least one additional evaporator and/or at least one additional arrangement of two or more evaporators can be connected to the refrigeration circuit 1.

During the service life of a refrigeration circuit, some components, e.g. the refrigeration consumer (i.e. expansion device and evaporator), heat exchanger, compressor, or other, of the refrigeration circuit may need to be functionally disconnected, e.g. for service. As used herein, the term "functionally disconnected" has the meaning that the component is no longer in fluid communication with the refrigerant flow path of the refrigeration circuit, although it may physically still be located within the refrigeration circuit. It is known to provide functionally disconnectable components comprising an upstream-side shut-off valve and a downstream-side shut-off valve; that way the component may be disconnected from the system. It is also known to provide at least two of the components in question in parallel; in case of replacement or maintenance of one component the other component continues to operate and is able to take over the task of the component being out of order or switched off. After being functionally disconnected these components are no longer in fluid communication with the system's safety valves and refrigerant within the functionally disconnected component may expand leading to increased pressure which is a safety concern.

For example, in case of service maintenances of throttle valves b, b' or evaporators 12, 12' the afore-mentioned shut-off valves a' and c' enable the disconnection of throttle valves b, b' and evaporators 12, 12' from the refrigeration circuit. Firstly, shut-off valve a' has to be closed to stop the flow of refrigerant via lines 9 and 10 to the evaporators 12, 12'. Now it has to be waited for approximately 10 to 15 minutes until shut-off valve c' can be closed to allow all liquid refrigerant within the evaporators 12, 12' to be vaporized and sucked off the evaporators 12, 12' by the compressors 2, 2'.

Unfortunately, it happens, that both shut-off valves a' and c' are closed simultaneously or that shut-off valve c' is closed too early by a service person. As a result the remaining liquid refrigerant within the evaporators 12, 12' vaporizes. This raises the pressure within the evaporators 12, 12' and the conduits 10, 11 between the evaporators 12, 12' and the shut-off valves a' and c' to a level the material of the evaporators 12, 12' and the conduits 10, 11 might not be able to withstand.

Especially, when so-called high-pressure refrigerants, for example CO2, are used, either the material of the evaporators 12, 12' or the conduits 10, 11 have to withstand pressures up to 80 bar, resulting in an increase of the investment costs of the material used for the evaporators 12, 12', the conduits 10, 11, the throttle valves b, b' and the shut-off valves a' and c'. According to the state of the art the shut-off valves a' and c' can be designed as three-way-valves, each being connected to a pressure control device, e.g. a pressure relief valve. As soon as the pressure within the evaporators 12, 12' and the conduits 10, 11 exceeds a determined pressure value, the vaporized refrigerant is led via at least one of these three-way-valves and pressure relief valves to the atmosphere or into a closed space. Especially the blow-off of refrigerant into a closed space might be harmful or hazardous. It is obvious, that both afore-mentioned solutions result in an unwelcome loss of refrigerant.

Accordingly, it is an object of the present invention to provide a refrigeration circuit, which avoids the afore-mentioned problems.

SUMMARY OF THE INVENTION

In accordance with an embodiment of the present invention this object is solved by an inventive refrigeration circuit for circulating a refrigerant in a predetermined flow direction through at least one functionally disconnectable component, the refrigeration circuit comprising in flow direction an expansion device, an evaporator, a compressor and a heat-rejecting heat exchanger, wherein an upstream-side shut-off valve is provided upstream of the component and a downstream-side shut-off valve is provided downstream of the component, characterized in that at least one of these shut-off valves is a non-return valve, i.e. a valve which blocks back flow of the refrigerant to the component it is associated with. If pressure within the functionally disconnected component increases above the pressure of the portion of the refrigerated circuit adjacent to the functionally disconnected component, the non-return valve allows refrigerant to flow back into the refrigeration circuit.

According to a preferred embodiment of the inventive refrigeration circuit, the component comprises in flow direction the expansion device and the evaporator.

According to a preferred embodiment of the inventive refrigeration circuit, the component comprises the compressor.

According to a preferred embodiment of the inventive refrigeration circuit, upstream-side shut-off valve provided upstream of the component and the downstream-side shut-off valve provided downstream of the component are non-return valves.

These non-return valves replace the well-known combination of three-way-valves and pressure relief valves. The advantages of this embodiment of the present invention is that no refrigerant has to be vented into the atmosphere or into a closed space and, therefore, no loss of refrigerant occurs. Furthermore, this embodiment of the present invention can be realized with any kind of refrigerant.

Should the downstream-side non-return valve be closed too early or simultaneously with the upstream-side non-return valve, the vaporized refrigerant will open the non-return valves automatically as soon as the pressure within the evaporator and the conduits between the evaporator and the non-return valves exceeds the pressure level within the refrigeration circuit. By opening at least one of these non-return valves the throttle valve and evaporator are again connected to the refrigeration circuit and the pressure is limited by the safety valves 14 and 16.

For the reasons mentioned above the materials used for the evaporator(s) and the conduit(s) between the component(s) and the non-return valves can be the same as the materials used for all other components of the refrigeration circuit.

In accordance with an embodiment of the present invention the downstream-side non-return valve, is lockable or blockable in its/open position.

According to an embodiment of the present invention the non-return valve(s), arranged in front of the throttle valve is lockable or blockable in its open position.

These embodiments of the present invention guarantee that during normal operation of the refrigeration circuit refrigerant can flow in both possible directions without being blocked at any time. Furthermore, the non-return valves can be closed by unlocking the blockade in their open position.

Embodiments of the present invention are described in greater detail below with references to the FIGS. 2 and 3, wherein both figures show schematic drawings of refrigeration circuits in accordance with embodiments of the invention

DETAILED DESCRIPTION

Figure 1:
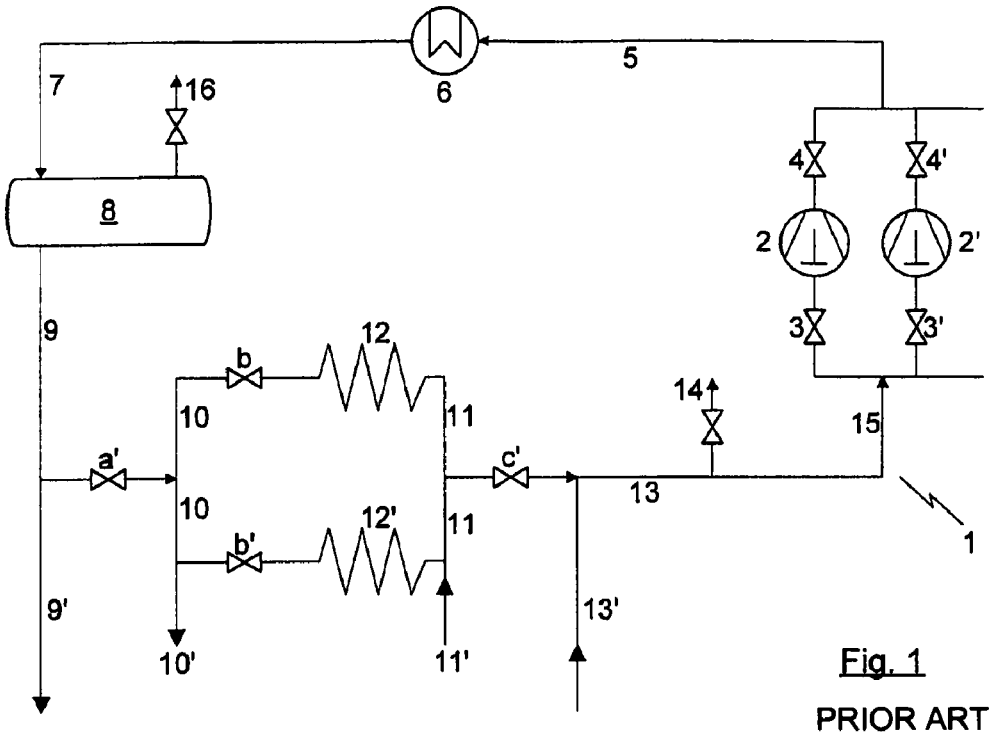
Fig. 1 PRIOR ART
FIG. 1 is a schematic drawing of a prior art refrigeration circuit.
Figure 2:
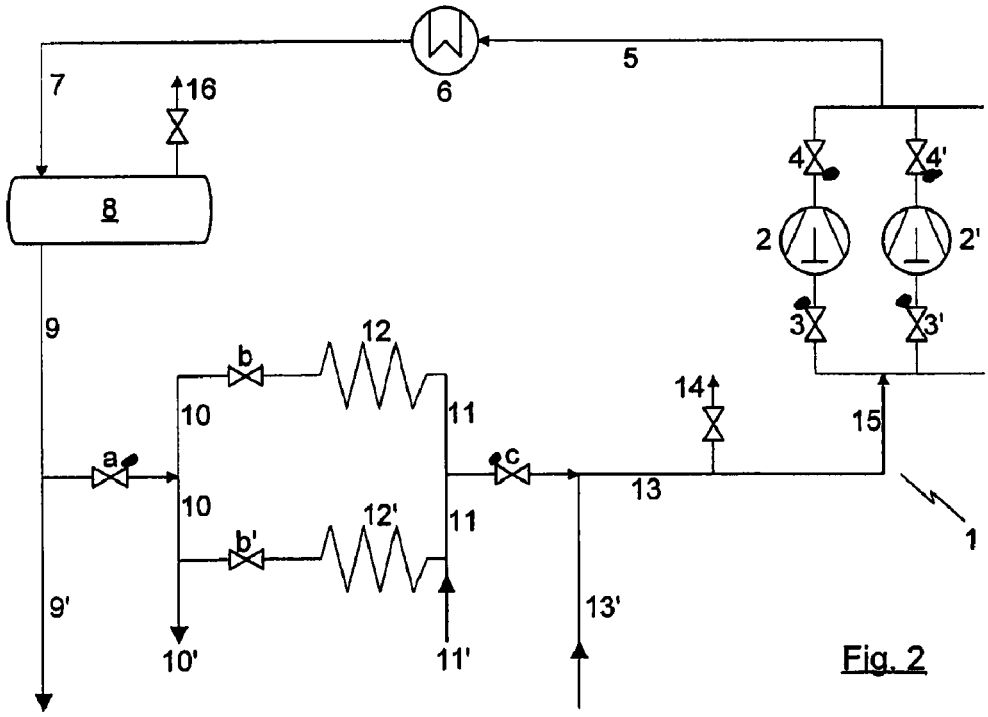

The refrigeration circuit 1 as shown in FIG. 2 is identical to the refrigeration circuit 1 as shown in FIG. 1 with one exception. The shut-off valves a' and c' as shown in FIG. 1 are replaced by non-return valves a and c. Non-return valves a and c have to be arranged in a way that refrigerant between both non-return valves can flow via these valves into conduit (s) 9 and/or 13.

The non-return valves a and c will open automatically as soon as the pressure within the evaporator(s) 12, 12' and the conduits 10, 10', 11, 11' between the evaporator(s) 12, 12' and the non-return valves a, c exceeds the pressure level within the suction conduit 13 and/or the so-called liquid-conduit 9 of the refrigeration circuit.

During the normal operation of the refrigeration circuit 1 the non-return valves a, c can be locked or blocked in their open position to allow the refrigerant to flow in both possible directions without being blocked at any time.

Still referring to FIG. 2, in case it is desired that the compressors 2, 2' are designed as functionally disconnectable components, at least one of the shut-off valves 3, 4 of the compressor 2; and, respectively, at least one of the shut-off valves 3', 4' of the compressor 2' may be provided as non-return valves. During the normal operation of the refrigeration circuit 1 these non-return valves (3, 3', 4, 4') can be locked or blocked in their open position to allow the refrigerant to flow in both possible directions without being blocked at any time.

Figure 3:
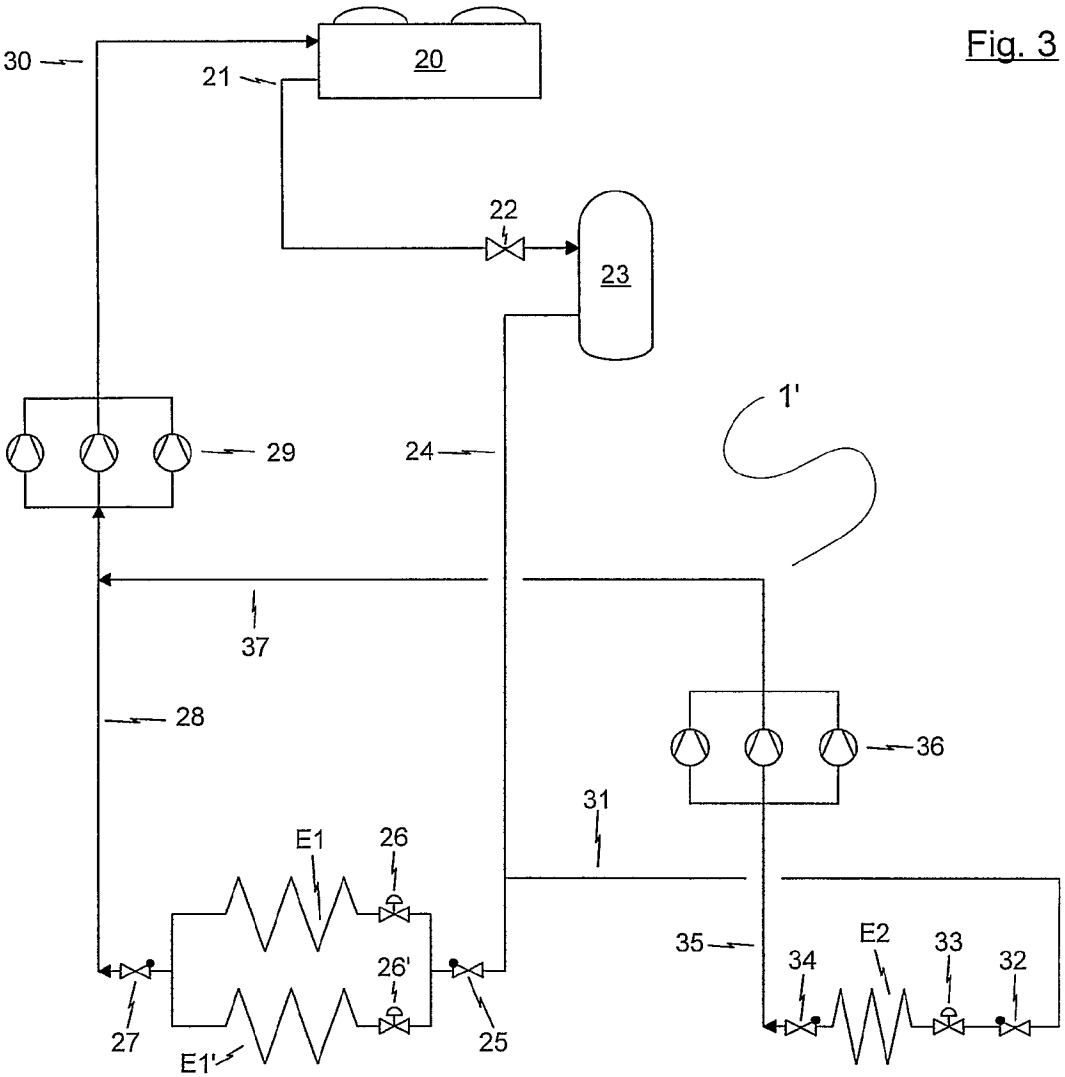

FIG. 3 shows a refrigeration circuit 1', especially for transcritical refrigerants, for example CO2. Such kind of refrigeration circuits are especially realized in supermarkets.

In flow direction this refrigeration circuit 1' comprises a compression stage 29, consisting of three compressors arranged in parallel. Not shown in FIG. 3 are the suction-side as well as the discharge-side shut-off valves. Within the compression stage 29 the gaseous refrigerant is compressed to a pressure up to 50 to 150 bar. These pressure values are necessary to enable an optimum operation or the refrigeration circuit 1' dependently from the outside temperatures during the winter and summer time.

Via conduit 30 the compressed refrigerant is led to a gas cooler/condenser 20, in which the refrigerant is cooled or liquefied, respectively. Subsequent to the gas cooler/condenser 20 an expansion device 22, which is connected to the gas cooler/condenser 20 via conduit 21, is arranged. The expansion device 22 reduces the pressure of the refrigerant to a middle-pressure of about 25 to 50 bar. As the compression stage 29, the gas cooler/condenser 20 and the expansion device 22 are normally arranged within the so-called machine-room or on the roof of a supermarket—and therefore not within the show-room of a supermarket—the materials for all components of the refrigeration circuit 1', which are arranged within the show-room of a supermarket can be chosen from the well-known materials.

Subsequent to the expansion device 22 a receiver 23 collects and stores the refrigerant for subsequent delivery—via conduits 24 and 31—to the evaporators E1 and E1'—symbolizing one or more refrigeration consumers—and to evaporator E2—symbolizing one or more low-temperature consumers. In front of each evaporator E1, E1', E2 a throttle valve 26, 26', 33 is arranged.

According to an embodiment of the present invention upstream of these throttle valves 26, 26', 33 and downstream of the evaporators E1, E1', E2 non-return valves 25, 27, 32, 34 are arranged. As can be seen in FIG. 3 non-return valves 25, 27 disconnect the arrangement of throttle valves 26, 26' and evaporators E1, E1' from the refrigeration circuit 1', while non-return valves 32, 34 disconnect throttle valve 33 and evaporator E2 from the refrigeration circuit 1'.

The exits of evaporators E1, E1' are connected to the compression stage 29 via suction conduit 28, while the exit of evaporator E2 is connected to the suction side of a second compression stage 36 via suction conduit 35. The second compression stage 36 compresses the refrigerant to the suction pressure of the (first) compression stage 29. The pressure side of the second compression stage 36 is connected to the suction side of the (first) compression stage 29 via conduit 37.

The afore-mentioned embodiments of the present invention can be realized in all kinds of refrigeration circuits.

The invention claimed is:

1. $CO_2$-Refrigeration circuit (1, 1') for circulating a $CO_2$-refrigerant in a predetermined flow direction through at least one functionally disconnectable component, the refrigeration circuit comprising in flow direction an expansion device (b, b', 26, 26', 33), an evaporator, a compressor (2, 2', 29, 36) and a heat-rejecting heat exchanger (6, 20), wherein an upstream-side shut-off valve is provided upstream of the component and a downstream-side shut-off valve is provided downstream of the disconnectable component, at least one of these shut-off valves being a non-return valve (a, c, 3, 3', 4, 4', 25, 27, 32, 34) which is adapted to allow flow back of the $CO_2$-refrigerant into an adjacent portion of the refrigeration circuit, if pressure within the functionally disconnected component increases above the pressure in the portion of the refrigeration circuit (1,1').

2. $CO_2$-Refrigeration circuit (1, 1') according to claim 1, wherein the component comprises in flow direction the expansion device (b, b', 26, 26', 33) and the evaporator (12, 12', E1, E1', E2).

3. $CO_2$-Refrigeration circuit (1, 1') according to claim 2, wherein the component comprises the compressor (2, 2').

4. $CO_2$-Refrigeration circuit (1, 1') according to claim 3, wherein the upstream-side shut-off valve and the downstream-side shut-off valve are non-return valves (a, c, 3, 3', 4, 4', 25, 27, 32, 34) which both are adapted to allow flow back of the refrigerant into an adjacent portion of the refrigeration circuit (1,1'), if the pressure within the functionally disconnected component increases above the pressure in the portion of the refrigeration circuit.

5. $CO_2$-Refrigeration circuit (1, 1') according to claim 4, wherein the downstream-side non-return valve (c, 4, 4', 27, 34) is lockable in its open state.

6. $CO_2$-Refrigeration circuit (1, 1') according to claim 5, wherein the upstream-side non-return valve (a, 3, 3', 25, 32) is lockable in its open state.

7. $CO_2$-Refrigeration circuit (1, 1') according to claim 1, wherein the component comprises the compressor (2, 2').

8. $CO_2$-Refrigeration circuit (1, 1') according to claim 7, wherein the upstream-side shut-off valve and the downstream-side shut-off valve are non-return valves (a, c, 3, 3', 4, 4', 25, 27, 32, 34) which both are adapted to allow flow back of the refrigerant into an adjacent portion of the refrigeration circuit (1,1'), if the pressure within the functionally disconnected component increases above the pressure in the portion of the refrigeration circuit.

9. $CO_2$-Refrigeration circuit (1, 1') according to claim 8, wherein the downstream-side non-return valve (c, 4, 4', 27, 34) is lockable in its open state.

10. $CO_2$-Refrigeration circuit (1, 1') according to claim 9, wherein the upstream-side non-return valve (a, 3, 3', 25, 32) is lockable in its open state.

11. $CO_2$-Refrigeration circuit (1, 1') according to claim 1, wherein the upstream-side shut-off valve and the downstream-side shut-off valve are non-return valves (a, c, 3, 3', 4, 4', 25, 27, 32, 34) which both are adapted to allow flow back of the refrigerant into an adjacent portion of the refrigeration circuit (1,1'), if the pressure within the functionally disconnected component increases above the pressure in the portion of the refrigeration circuit.

12. $CO_2$-Refrigeration circuit (1, 1') according to claim 11, wherein the downstream-side non-return valve (c, 4, 4', 27, 34) is lockable in its open state.

13. $CO_2$-Refrigeration circuit (1, 1') according to claim 12, wherein the upstream-side non-return valve (a, 3, 3', 25, 32) is lockable in its open state.

14. $CO_2$-Refrigeration circuit (1, 1') according to claim 1, wherein the downstream-side non-return valve (c, 4, 4', 27, 34) is lockable in its open state.

15. $CO_2$-Refrigeration circuit (1, 1') according to claim 14, wherein the upstream-side non-return valve (a, 3, 3', 25, 32) is lockable in its open state.

16. $CO_2$-Refrigeration circuit (1, 1') according to claim 1, wherein the upstream-side non-return valve (a, 3, 3', 25, 32) is lockable in its open state.

* * * * *